US008090308B2

(12) United States Patent
Itoh

(10) Patent No.: US 8,090,308 B2
(45) Date of Patent: Jan. 3, 2012

(54) CONTINUOUS PAPER FEED DEVICE, IMAGE FORMING APPARATUS, CONTINUOUS PAPER FEEDING METHOD AND COMPUTER READABLE MEDIA STORING PROGRAM

(75) Inventor: Keiji Itoh, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 738 days.

(21) Appl. No.: 12/245,965

(22) Filed: Oct. 6, 2008

(65) Prior Publication Data

US 2009/0236385 A1 Sep. 24, 2009

(30) Foreign Application Priority Data

Mar. 24, 2008 (JP) ..... 2008-075074

(51) Int. Cl.
*B41J 11/70* (2006.01)
*G03G 15/00* (2006.01)

(52) U.S. Cl. ..... 399/385; 399/23; 400/621

(58) Field of Classification Search ..... 399/385, 399/387, 23; 400/621
See application file for complete search history.

(56) References Cited

U.S. PATENT DOCUMENTS 6,091,928 A * 7/2000 Fuchisawa ..... 399/384
2003/0035671 A1* 2/2003 Estabrooks ..... 399/385

FOREIGN PATENT DOCUMENTS

| | | | |
|---|---|---|---|
| JP | A-1-231745 | | 9/1989 |
| JP | 06278938 | A * | 10/1994 |
| JP | A-6-278938 | | 10/1994 |
| JP | A 8-91651 | | 4/1996 |
| JP | A 9-249341 | | 9/1997 |
| JP | A-2002-284439 | | 10/2002 |
| JP | A 2004-136514 | | 5/2004 |

OTHER PUBLICATIONS

Mar. 5, 2010 Office Action issued in Japanese Patent Application No. 2008-075074 (with translation).

* cited by examiner

*Primary Examiner* — Daniel J Colilla
(74) *Attorney, Agent, or Firm* — Oliff & Berridge, PLC

(57) ABSTRACT

A continuous paper feed device includes a paper feed unit that feeds continuous paper to an image output part; a slack forming unit that forms a slack of continuous paper on a paper transport path; a detecting unit that detects a remaining amount of continuous paper; a cutting unit that cuts the continuous paper; and a cutting controller that controls the cutting unit to cut the continuous paper during a time taken to tighten the slack formed, when paper more than a predefined value which has been set beforehand is transported, and if the remaining amount of paper detected by the detecting unit is more than a threshold value, the cutting controller performing control operation including reducing a length of a slack formed by the slack forming unit and transporting the continuous paper, followed by forming a slack again by the slack forming unit.

13 Claims, 6 Drawing Sheets

CONTINUOUS PAPER FEED DEVICE, IMAGE FORMING APPARATUS, CONTINUOUS PAPER FEEDING METHOD AND COMPUTER READABLE MEDIA STORING PROGRAM

CROSS-REFERENCE TO RELATED APPLICATIONS

This application is based on and claims priority under 35 USC 119 from Japanese Patent Application No. 2008-075074 filed Mar. 24, 2008.

BACKGROUND

Technical Field

The present invention relates to a continuous paper feed device, an image forming apparatus, a continuous paper feeding method and a computer readable media storing program.

SUMMARY

According to an aspect of the present invention, there is provided a continuous paper feed device including a paper feed unit that feeds continuous paper to an image output part; a slack forming unit that forms a slack of continuous paper on a paper transport path through which the continuous paper is fed by the paper feed unit; a detecting unit that detects a remaining amount of continuous paper; a cutting unit that cuts the continuous paper; and a cutting controller that controls the cutting unit to cut the continuous paper during a time taken to tighten the slack formed by the slack forming unit, when paper more than a predefined value which has been set beforehand is transported, and if the remaining amount of paper detected by the detecting unit is equal to or more than a threshold value, the cutting controller performing one mode of control operation including reducing a length of a slack formed by the slack forming unit and transporting the continuous paper, followed by forming a slack again by the slack forming unit and cutting the continuous paper during a time taken to tighten the slack, or if the remaining amount of paper detected by the detecting unit is less than the threshold value, the cutting controller performing another mode of control operation including transporting the continuous paper with a slack formed thereon by the slack forming unit and cutting the continuous paper during a time taken to tighten the slack.

BRIEF DESCRIPTION OF THE DRAWINGS

An exemplary embodiment of the present invention will be described in detail based on the following figures, wherein.

DETAILED DESCRIPTION

Background

Figure 1:
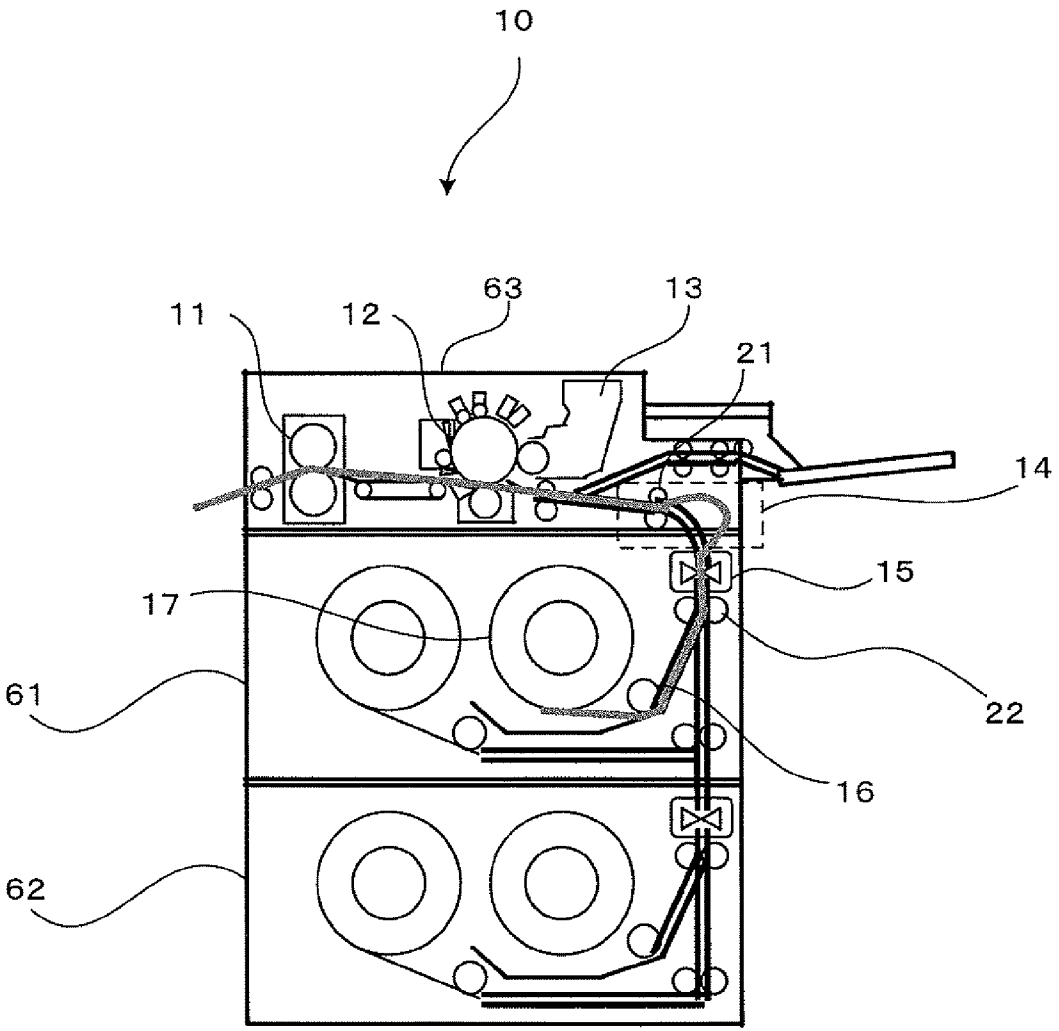
FIG. 1 is a diagram depicting a structure of an image forming apparatus 10 of an exemplary embodiment of the present invention.

To help understanding of the present invention, its background and outline are first described.

Some types of image forming apparatus such as copiers and printers adapted for producing large-size prints such as drawings are provided with a paper feed device for feeding continuous paper like roll paper and is configured to form an image on roll paper fed by the paper feed device. In the image forming apparatus of these types, the paper feed device is provided with a cutter that cuts roll paper to a certain length and an image is formed on the thus cut paper.

However, if roll paper being transported is cut by the cutter, a problem that roll paper may be damaged arises. To stop the transport of roll paper when it is cut has an adverse effect on the image forming process such as disturbing a produced image.

For this reason, the image forming apparatus of this type, in order to avoid an adverse effect when paper is cut, the following method is used: slacken paper (forming a loop of paper) on a transport path, stop the driving of the paper feed device when cutting paper, and cut paper during time taken to tighten the slack (make the loop disappear). In this way, a loop is used as a buffer for cutting paper.

In such a case, paper with a loop formed thereon is transported. For paper of regular sizes up to A0, it is unlikely that transporting such a partially looped paper poses a problem. However, for longer size paper (2 to 15 m) over A0, beyond the regular sizes, when such a partially looped paper is transported, a small misalignment in mechanical parts may cause buckling of the loop, which in turn may damage paper, or a serpentine glide of paper may occur because paper has no tension. Accordingly, some contrivances have been taken to stabilize paper transportability during run of longer size paper, including temporarily stopping the driving upstream of the loop and decreasing the transport speed, thereby reducing the loop length and increasing the tension on paper. In this case, the upstream transport speed is increased immediately before a regular paper length is attained, a loop is formed again, and paper is cut.

By the way, in the image forming apparatus using roll paper, when a roll paper end has been detected during paper run, it is generally performed to cut and eject the paper. This avoids that a piece of long paper remains in the apparatus and an additional operation for removing it has to be performed.

However, the end of roll paper is generally fixed to its paper core. In the case where the above control to increase the tension on paper is exerted, a loop cannot be produced upon the roll paper end. Paper cutting by the cutter in this condition might result in the following disadvantages: because paper to which a strong tension is applied is cut, a large load is applied to the cutter, which causes a trouble; there occurs an abnormal sound when roll paper breaks; and with tearing paper apart when cutting begins from one end across the width of paper, resulting small pieces of paper remain in the apparatus, which may cause a jam and a fault.

Exemplary Embodiment

In the following, an exemplary embodiment of the present invention will be described in detail with reference to the drawings.

FIG. 1 is a cross sectional diagram depicting a configuration of an image forming apparatus 10 of an exemplary embodiment of the present invention. The image forming apparatus 10, as depicted in FIG. 1, includes an image forming unit (image output part) 63, which is composed of a fixing device 11, a photoreceptor drum 12, a development device 13, a loop forming part 14, and other components, and roll paper feed devices (continuous paper feed devices) 61, 62 that feed roll paper (continuous paper) to the image forming unit 63. Each of the roll paper feed device 61, 62 includes a cutter (cutting unit) 15, a feed roller 16, and a roll paper 17. In an example presented here, two vertically disposed roll paper feed devices 61, 62 which can accommodate two roll papers are installed. Because the roll paper feed devices 61, 62 have the same structure, only the roll paper feed device 61 will be discussed in the following description.

The feed roller 16 is positioned upstream of transport rollers 22 and functions as a paper feeding part that feeds the roll paper 17 to the image forming unit 63. The loop forming part 14 forms a loop (slack) of the roll paper 17 on a paper transport path (from the transport rollers 22 up to upper transport rollers 21) through which the roll paper 17 is fed by the feed roll 16 to the image forming unit 63.

In the image forming unit 63, the photoreceptor drum 12 is irradiated with light from an exposure device and an electrostatic latent image is formed thereon. The electrostatic latent image formed on the photoreceptor drum 12 is developed by the development device 13 and a toner image on the photoreceptor drum 12 developed by the development device 13 is transferred onto the roll paper being transported. The toner image transferred onto the roll paper is fixated to the roll paper by the fixing device 11.

Figure 2:
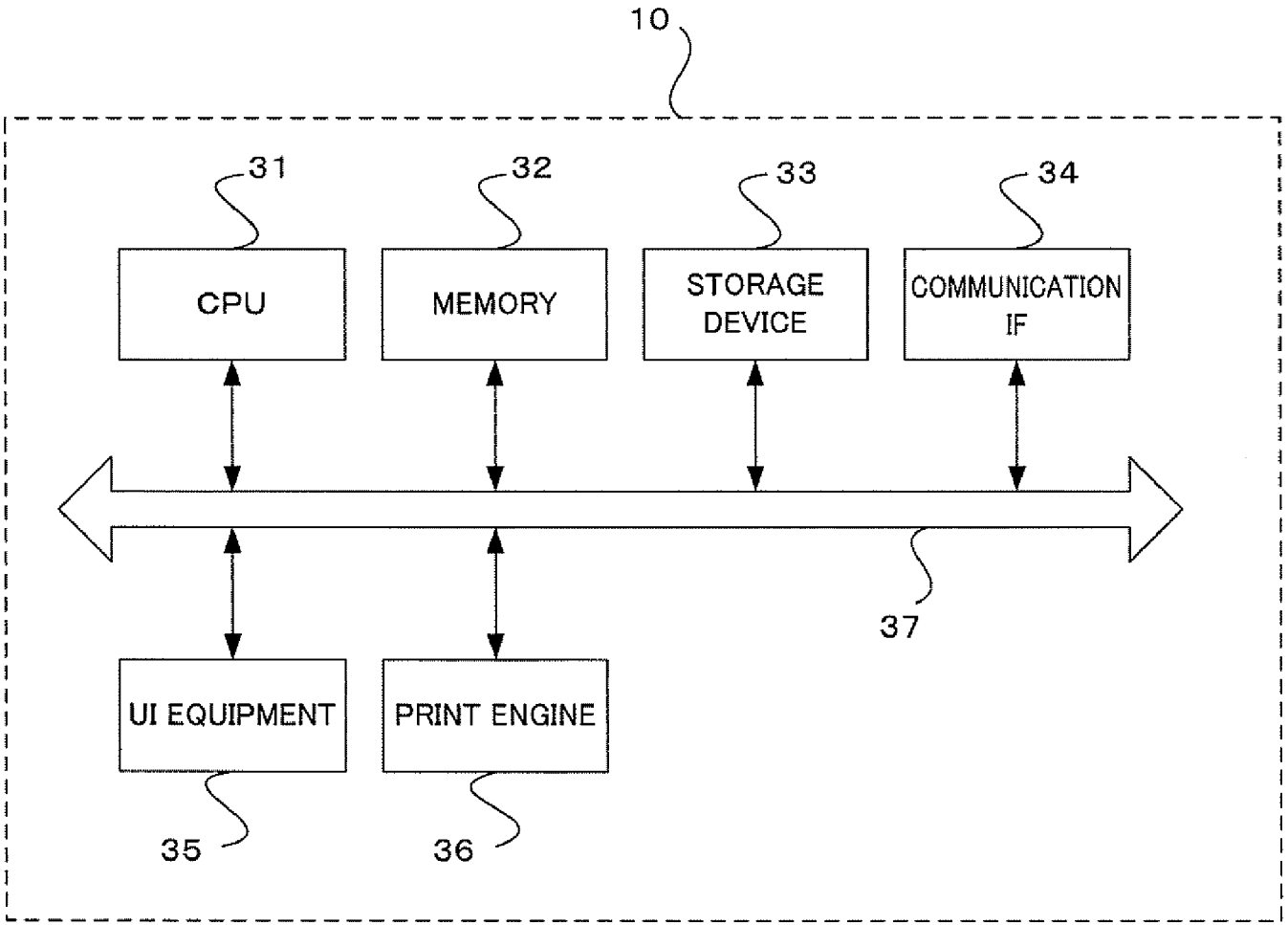
FIG. 2 is a diagram showing a hardware structure of the image forming apparatus 10 of an exemplary embodiment of the present invention.

Then, a hardware structure of the image forming apparatus 10 in the image forming system of the present exemplary embodiment is shown in FIG. 2.

The image forming apparatus 10, as shown in FIG. 2, includes a CPU 31, a memory 32, a storage device 33 such as a hard disk drive (HDD), a communication interface (IF) 34 for transmitting and receiving data to/from an external device via a network, user interface (UI) equipment 35 including a touch panel or a liquid crystal display and a keyboard, and a print engine 36. These components are interconnected via a control bus 37.

The CPU 31 performs predetermined processing based on a control program stored in the memory 32 or storage device 33 and controls the operation of the image forming apparatus 10.

In the present exemplary embodiment described herein assumes that the CPU 31 reads the control program from the memory 32 or storage device 33 and executes the program. Alternatively, the program may be stored in a storage medium such as CD-ROM and provided to the CPU 31.

Figure 3:
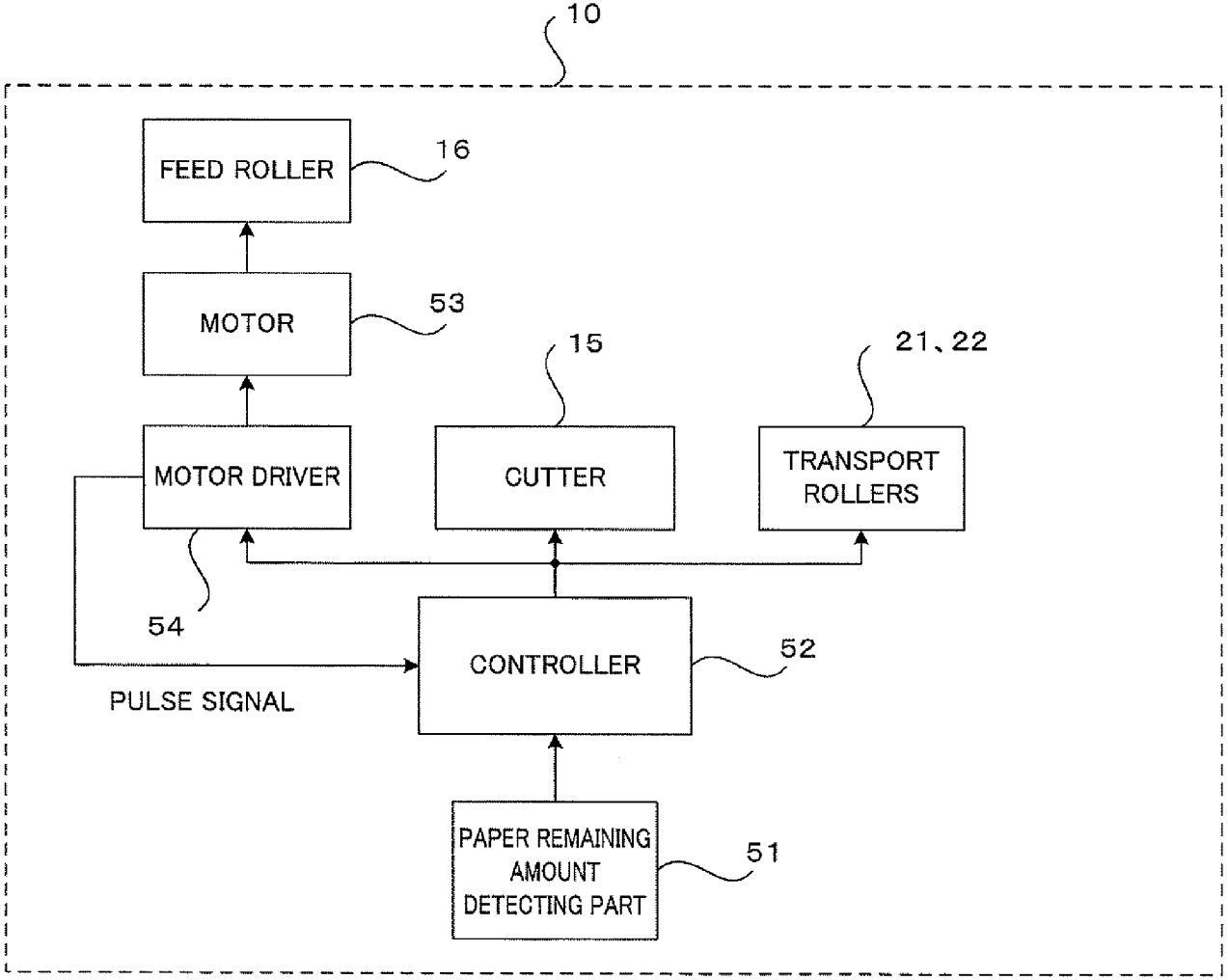
FIG. 3 is a block diagram showing an arrangement of functions for paper feeding of the image forming apparatus 10 of an exemplary embodiment of the present invention.

FIG. 3 is a block diagram showing an arrangement of functions for paper feeding of the image forming apparatus 10, wherein these functions are implemented by executing the above control program.

The image forming apparatus 10 of the present exemplary embodiment, as shown in FIG. 3, includes a paper remaining amount detecting part 51, a controller 52, a cutter 15, a motor 53 for rotating the feed roller 16, a motor driver 54 for control of rotation of the motor 53 and transport rollers 21, 22.

The paper remaining amount detecting part 51 has a function that detects the remaining amount of the roll paper 17 and conveys it to the controller 52.

The controller 52 controls the operations of the feed roller 16, cutter 15, transport rollers 21, 22, etc. based on the remaining amount of the roll paper 17 detected by the paper remaining amount detecting part 51. That is, the controller 52 functions as a transport controller that controls transport of the roll paper 17 and a cutting controller that controls the cutter 15 to cut the roll paper 17.

In particular, if a paper length specified for an accepted print job (print request) is more than a predefined value, e.g., A0 size, which has been set beforehand, the controller 52 controls the operation to reduce the loop length (slack length) of a loop formed by the loop forming part 14 and apply tension to the roll paper 17. When the blank paper length to be used becomes less than a given value, the controller 52 controls the loop forming part 14 to increase the loop to be formed so that the loop is formed when the roll paper 17 is cut. Here, the paper length more than the predefined value is the paper length for which it is required to reduce the initially formed loop and apply tension to the roll paper 17.

However, if the paper length specified for the accepted print job is longer than the remaining amount of the roll paper 17 detected by the paper remaining amount detecting part 51, the controller 52 does not perform the control for reducing the loop length even if the paper length specified for the accepted print job is more than A0 size that is the predefined value which has been set beforehand.

Accordingly, if the paper length specified for the accepted print job is more than the predefined value which has been set beforehand and shorter than the remaining amount of the roll paper 17 detected by the paper remaining amount detecting part 51, the controller 52 reduces the length of a loop formed by the loop forming part 14. When the blank paper length to be used becomes less than the given value, the controller 52 controls the loop forming part 14 to increase the loop to be formed by the loop forming part 14.

If the paper length specified for the accepted print job is more than the predefined value which has been set beforehand and longer than the remaining amount of the roll paper 17 detected by the paper remaining amount detecting part 51, the controller 52 controls the loop forming part 14 so that the roll paper 17 with a loop formed thereon by the loop forming part 14 is transported.

If the paper length specified for the accepted print job is shorter than the predefined value which has been set beforehand, the controller 52 controls the loop forming part 14 so that the roll paper 17 with a loop formed thereon by the loop forming part 14 is transported.

Consequently, if the paper length specified for the accepted print job is longer than the remaining amount of the roll paper 17 detected by the paper remaining amount detecting part 51, the controller 52 controls the cutter 15 to cut the continuous paper during a time taken to stretch the loop formed by the loop forming part 14, when the roll paper 17 has run out.

In the present exemplary embodiment, the control operation for roll paper feed depending on an accepted print job as a print request is explained, but the present invention is not limited to such a case. The present invention is equally applicable to a case where, for example, a copy instruction or the like is accepted and an image is formed on continuous paper according to the accepted copy instruction or the like.

As for timing of detecting the remaining amount of the roll paper 17, this detection may be performed when a print job or copy instruction has been accepted, when paper reading has been completed, or before an initially produced loop is reduced.

The cutter 15 is a cutting unit that cuts the roll paper 17 during a time taken to stretch the loop formed by the loop forming part 14. The controller 52 controls the cutter 15 to cut continuous paper 17 when the length of the roll paper 17 fed to the image forming unit 63 has reached the paper length specified by a print job or at the time of roll end, when the roll paper 17 has run out.

Here, the image forming apparatus 10 is configured to include a function of counting a paper length to feed. For this purpose, it suffices to obtain information about rotation of the feed roller 16. Here, the apparatus is configured such that a pulse signal for control of the motor 53 for driving the feed roller 16 is fed back from the motor driver 54 to the controller 52.

Then, a concrete example of construction of the paper remaining amount detecting part 51 in FIG. 3 is described with reference to FIG. 4.

Figure 4:
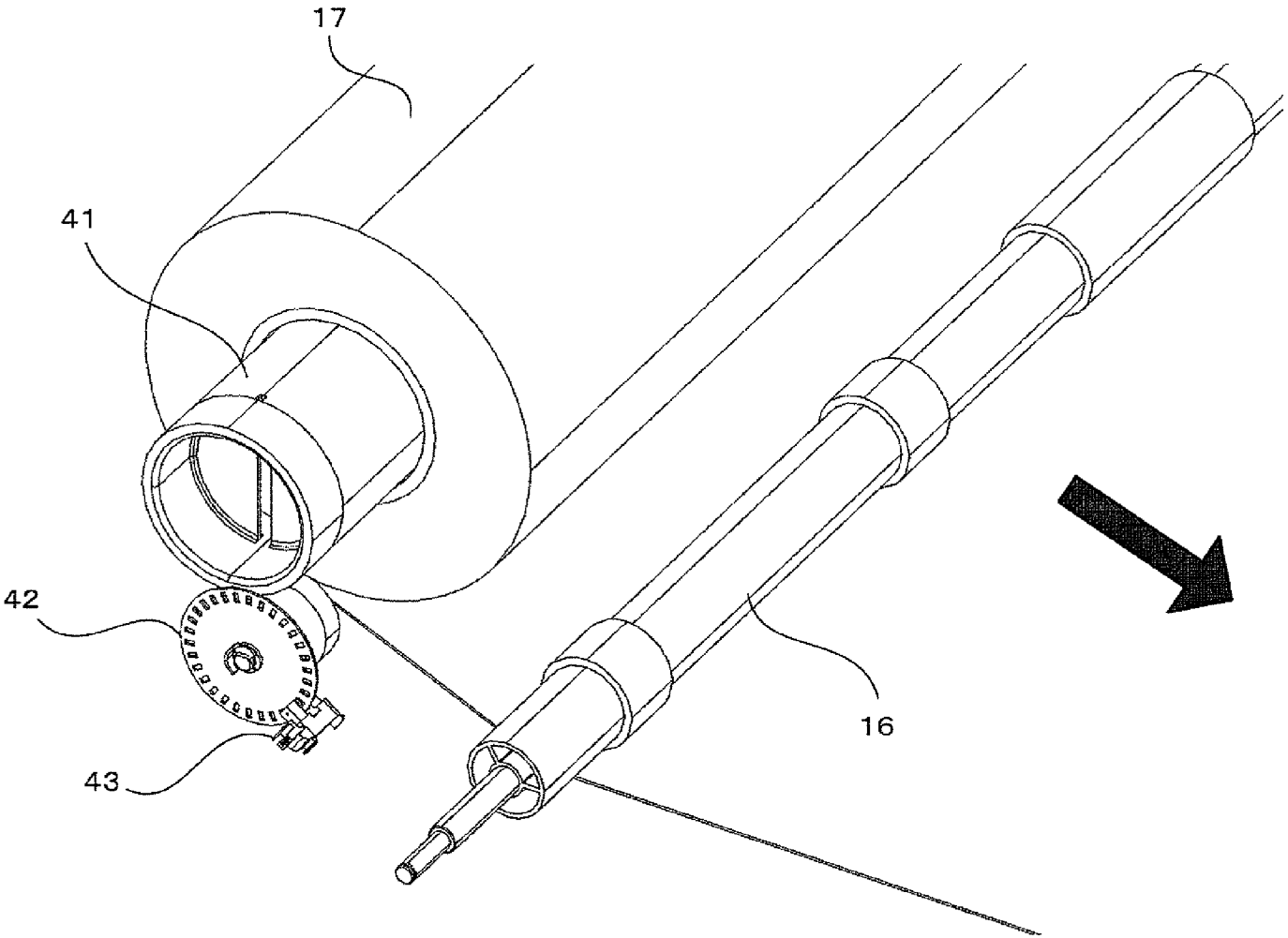
FIG. 4 illustrates a concrete example of a remaining amount of paper detector in the image forming apparatus 10 of an exemplary embodiment of the present invention.

In FIG. 4, the paper remaining amount detecting part 51 is constructed with a disk 42 and a photo sensor 43. The feed roller 16 is driven by the motor 53 shown in FIG. 3 and reels out the roll paper 17 in the arrow direction. Thereby, the roll paper 17 and the paper shaft (core) 41 rotate and, by a suitable mechanism, this rotation is conveyed to the disk 42 via a gear. The disk 42 has a large number of slits which are radially arranged. The photo sensor 43 is located to interpose the disk 42 between its parts. The photo sensor 43 is configured such that light emitted from a light emitting part and passing through a slit is detected by a light receiving part.

Figure 5:
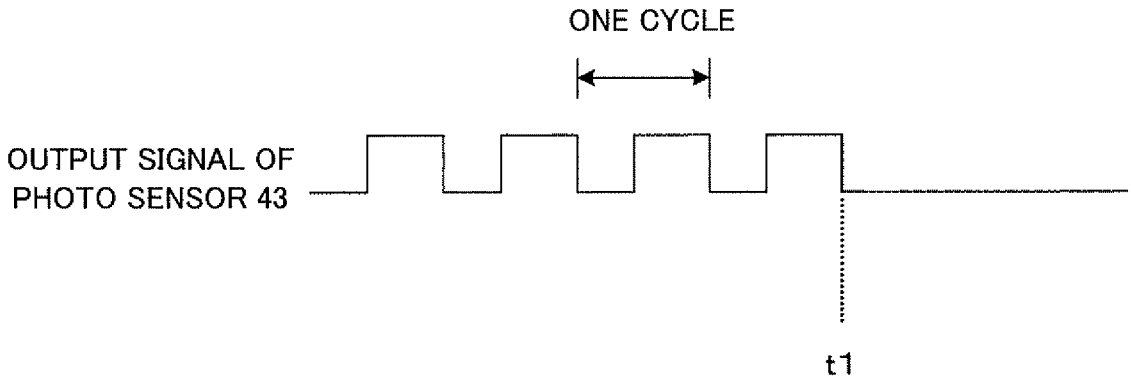
FIG. 5 illustrates an output signal of a photo sensor 43.

One example of an output signal of this photo sensor is presented in FIG. 5. As shown in FIG. 5, the output signal of the photo sensor 43 is a pulse signal. One cycle of the output signal changes depending on the speed of rotation of the paper shaft 41. When the roll paper 17 is transported by the feed roller 16 at a constant speed, the number of rotations of the paper shaft 41 for a given period of time, that is, on/off periods (cycles) detected by the photo sensor 43 change, as the outside diameter of the roll paper 17 changes. In other words, the number of pulses detected for a given period of time changes. It will be expedient to measure the outside diameter of the roll paper 17, that is, the remaining amount of paper in terms of the detected number of pulses. As illustrated in FIG. 5, pulse signal output is no longer provided after time t1, when no pulse will be detected for a given period of time. This indicates that the rotation of the roll paper 17 is stopped, that is, it can be determined that it is the time of roll paper end.

Then, the paper feeding operation of the image forming apparatus 10 of the present exemplary embodiment is described in detail with reference to the drawing.

Figure 6:
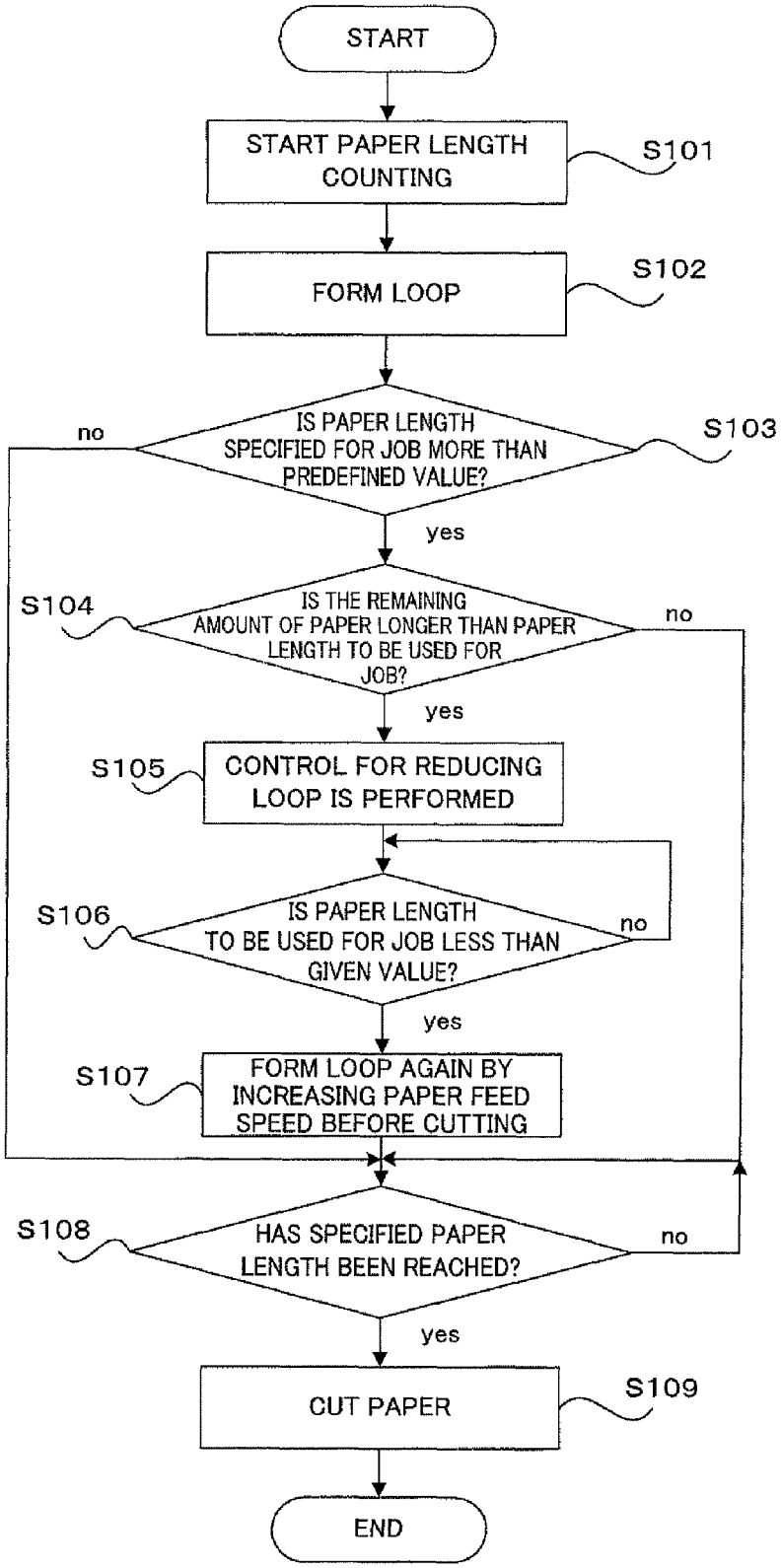
FIG. 6 is a flowchart illustrating the operation of the image forming apparatus 10 of an exemplary embodiment of the present invention.

FIG. 6 is a flowchart illustrating the operation of the image forming apparatus 10 of the present exemplary embodiment.

When the image forming apparatus 10 accepts a print job, and when the roll paper 17 is reeled out by the feed roller 16 and paper feeding to the image forming unit 63 starts, counting a paper length fed to the image forming unit 63 is started (step S101).

The roll paper 17 fed by the feed roller 16 passes the cutter 15 and is temporarily stopped at the transport rollers 21, and a loop is formed (step S102). When the formed loop has become large up to a predetermined size, the rotation of the transport rollers 21 is restarted and the roll paper 17 is transported to the image forming unit 63.

Then, it is determined whether the paper length specified by the print job is more than a predefined value, e.g., A0 size which has been set beforehand (step S103). If the paper length specified by the print job is shorter than the predefined value which has been set beforehand, as determined at step S103, control for reducing the loop is not performed and paper length counting is continued until the fed paper length has reached the paper length specified by the print job (step S108). When the fed paper length has reached the specified length, only the driving of the roll paper feed device 61 is stopped and the paper is cut by the cutter 15 during a time taken to stretch the loop formed in the loop forming part 14 (step S109). That is, the paper is cut by the cutter 15, while the image forming operation is continued. Here, it will be expedient to calculate the loop length L by the following equation (1), wherein the loop length is zeroed during a time T for paper cutting when the paper is transported at a velocity V in the image forming unit 63.

$$L=T\times V \tag{1}$$

As determined at step S103, if the paper length specified by the print job is more than the predefined value which has been set beforehand, a comparison is made between the remaining amount of paper detected by the paper remaining amount detecting part 51 and the remaining (blank) paper length to be used for the print job (step S104).

As determined at step S104, if the remaining amount of paper detected by the paper remaining amount detecting part 51 is longer than the paper length to be used for the print job, that is, an image formation specified by the print job can be completed without paper run-out, control is performed to reduce the length of the loop formed to stabilize paper feed performance and to increase the tension on the paper (step S105).

In particular, a specific value to determine whether paper length is exceptionally long is set and, when the result of paper length counting has reached the specific value, the feed roller 16 is stopped. The driving of the roll paper feed device 61 is temporarily stopped to reduce the loop. If the loop is completely stretched, an impact on the paper gives rise to an adverse effect on an image produced on the paper. Hence, with a slight slack remaining, the driving of the roll paper feed device 61 is restarted. At this time, the paper feed speed of the roll paper feed device 61 is set slightly slower than the paper speed in the image forming unit 63. Thereby, it is possible to increase the tension on the paper without having an adverse effect on an image produced on the paper.

The image forming operation is continued in this condition. Immediately before the specified paper length has been reached, that is, when the paper length to be used for the job has become less than a given value (step S106), a loop having the loop length L, as in the above equation 1, is formed again by increasing the paper feed speed of the roll paper feed device 61 (step S107). When the specified paper length has been reached with the loop formed (step S108), the driving of the roll paper feed device 61 is stopped and the paper is cut by the cutter (step S109).

However, as determined at step S104, if the remaining amount of paper detected by the paper remaining amount detecting part 51 is shorter than the paper length to be used for the print job, that is, the paper will run out before completion of the image formation specified by the print job, control for reducing the loop is not performed and paper feeding is continued toward the specified paper length (step S108). However, in this case, the specified paper length is not reached, because the roll paper runs out during the image formation.

Upon detecting the roll paper end, the paper is cut by the cutter 15 and ejected outside of the apparatus. In this case, since the control for reducing the loop is not performed, paper with a loop formed thereon is cut even if the roll paper end occurs during image output.

Modification Example

In the above-described exemplary embodiment, the control scheme is illustrated in which the controller 52 does not perform the control for reducing the loop length, if the blank paper length to be used for the accepted print job is longer than the remaining amount of the roll paper 17 detected by the paper remaining amount detecting part 51, as in step S104, even if the paper length specified for the accepted print job is more than A0 size that is the predefined value which has been set beforehand. However, the present invention is not limited to this scheme. The control scheme may be modified such that the controller 52 does not perform the control for reducing the loop length, if the remaining amount of the roll paper 17 detected by the paper remaining amount detecting part 51 has become less than a threshold value which has been set beforehand, even if the paper length specified for the accepted print job is more than A0 size that is the predefined value which has been set beforehand. This variation of the control scheme can be implemented by using a threshold value which has been set instead of the paper length to be used for the accepted print job in the above-described exemplary embodiment.

The present invention may be embodied in other specific forms without departing from its spirit or characteristics. The described exemplary embodiments are to be considered in all respects only as illustrated and not restrictive. The scope of the present invention is, therefore, indicated by the appended claims rather than by the foregoing description. All changes which come within the meaning and range of equivalency of the claims are to be embraced within their scope.

What is claimed is:

1. A continuous paper feed device comprising:

a paper feed unit that feeds continuous paper to an image output part;

a slack forming unit that forms a slack of continuous paper on a paper transport path through which the continuous paper is fed by the paper feed unit;

a detecting unit that detects a remaining amount of continuous paper;

a cutting unit that cuts the continuous paper; and a cutting controller that controls the cutting unit to cut the continuous paper during a time taken to tighten the slack formed by the slack forming unit, when paper whose length is more than a predefined value which has been set beforehand is transported, and if the remaining amount of paper detected by the detecting unit is equal to or more than a threshold value, the cutting controller performs one mode of control operation including reducing a length of a slack formed by the slack forming unit and transporting the continuous paper, followed by forming a slack again by the slack forming unit and cutting the continuous paper during a time taken to tighten the slack, or if the remaining amount of paper detected by the detecting unit is less than the threshold value, the cutting controller performs another mode of control operation including transporting the continuous paper with a slack formed thereon by the slack forming unit and cutting the continuous paper during a time taken to tighten the slack.

2. The continuous paper feed device according to claim 1, wherein the detecting unit detects the remaining amount of continuous paper by measuring a speed of rotation of a paper core around which the continuous paper is wrapped.

3. A continuous paper feed device comprising:

a paper feed unit that feeds continuous paper to an image output part;

a slack forming unit that forms a slack of continuous paper on a paper transport path through which the continuous paper is fed by the paper feed unit;

a detecting unit that detects a remaining amount of continuous paper;

a cutting unit that cuts the continuous paper; and a cutting controller that controls the cutting unit to cut the continuous paper during a time taken to tighten the slack formed by the slack forming unit, when paper whose length is more than a predefined value which has been set beforehand is transported, and if a paper length specified for a print request accepted is shorter than the remaining amount of paper detected by the detecting unit, the cutting controller performs one mode of control operation including reducing a length of a slack formed by the slack forming unit and transporting the continuous paper, followed by forming a slack again by the slack forming unit and cutting the continuous paper during a time taken to tighten the slack, or if the paper length specified for the print request accepted is longer than the remaining amount of paper detected by the detecting unit, the cutting controller performs another mode of control operation including transporting the continuous paper with a slack formed by the slack forming unit and cutting the continuous paper during a time taken to tighten the slack.

4. A continuous paper feed device comprising:

a paper feed unit that feeds continuous paper to an image output part;

a slack forming unit that forms a slack of continuous paper on a paper transport path through which the continuous paper is fed by the paper feed unit;

a detecting unit that detects a remaining amount of continuous paper;

a cutting unit that cuts the continuous paper;

a transport controller that, when transporting paper whose length is more than a predefined value which has been set beforehand, and if the remaining amount of paper detected by the detecting unit is equal to or more than a threshold value, performs one mode of control operation including reducing a length of a slack formed by the slack forming unit and transporting the continuous paper, followed by forming a slack again by the slack forming unit, or if the remaining amount of paper detected by the detecting unit is less than the threshold value, performs another mode of control operation including transporting the continuous paper with a slack formed thereon by the slack forming unit; and a cutting controller that controls the cutting unit to cut the continuous paper during a time taken to tighten the slack formed by the slack forming unit.

5. The continuous paper feed device according to claim 4, wherein the transport controller, if a paper length specified for a print request accepted is more than the predefined value and the remaining amount of paper detected by the detecting unit is equal to or more than the threshold value, controls the slack forming unit to reduce the length of a slack formed by the slack forming unit and, when a blank paper length to be used becomes less than a given value, increases the length of the slack formed by the slack forming unit, the transport controller, if the paper length specified for the print request accepted is more than the predefined value and the remaining amount of paper detected by the detecting unit is less than the threshold value, controls the slack forming unit so that the continuous paper with a slack formed thereon by the slack forming unit is transported, the transport controller, if the paper length specified for the print request accepted is shorter than the predefined value, controls the slack forming unit so that the continuous paper with a slack formed thereon by the slack forming unit is transported, and the cutting controller controls the cutting unit to cut the continuous paper during a time taken to tighten the slack formed by the slack forming unit, when the length of the continuous paper fed to the image output part has reached the paper length specified by the print request or when the continuous paper has run out.

6. A continuous paper feed device comprising:

a paper feed unit that feeds continuous paper to an image output part;

a slack forming unit that forms a slack of continuous paper on a paper transport path through which the continuous paper is fed by the paper feed unit, a detecting unit that detects a remaining amount of continuous paper;

a cutting unit that cuts the continuous paper;

a transport controller that, when transporting paper whose length is more than a predefined value which has been set beforehand, and if a paper length specified for a print request accepted is shorter than the remaining amount of paper detected by the detecting unit, performs one mode of control operation including reducing a length of a slack formed by the slack forming unit and transporting the continuous paper, followed by forming a slack again by the slack forming unit, or if the paper length specified for the print request accepted is longer than the remaining amount of paper detected by the detecting unit, performs another mode of control operation including transporting the continuous paper with a slack formed thereon by the slack forming unit; and a cutting controller that controls the cutting unit to cut the continuous paper during a time taken to tighten the slack formed by the slack forming unit.

7. The continuous paper feed device according to claim 6, wherein the transport controller, if the paper length specified for the print request accepted is more than the predefined value and shorter than the remaining amount of paper detected by the detecting unit, controls the slack forming unit to reduce the length of a slack formed by the slack forming unit and, when a blank paper length to be used becomes less than a given value, increases the length of the slack formed by the slack forming unit, the transport controller, if the paper length specified for the print request accepted is more than the predefined value and longer than the remaining amount of paper detected by the detecting unit, controls the slack forming unit so that the continuous paper with a slack formed thereon by the slack forming unit is transported, the transport controller, if the paper length specified for the print request accepted is shorter than the predefined value, controls the slack forming unit so that the continuous paper with a slack formed thereon by the slack forming unit is transported, and the cutting controller controls the cutting unit to cut the continuous paper during a time taken to tighten the slack formed by the slack forming unit, when the length of the continuous paper fed to the image output part has reached the paper length specified by the print request or when the continuous paper has run out.

8. An image forming apparatus comprising:

an image output part that outputs an image on continuous paper;

a paper feed unit that feeds continuous paper to the image output part;

a slack forming unit that forms a slack of continuous paper on a paper transport path through which the continuous paper is fed by the paper feed unit;

a detecting unit that detects a remaining amount of continuous paper;

a cutting unit that cuts the continuous paper;

a transport controller that, when transporting paper whose length is more than a predefined value which has been set beforehand, and if the remaining amount of paper detected by the detecting unit is equal to or more than a threshold value, performs one mode of control operation including reducing a length of a slack formed by the slack forming unit and transporting the continuous paper, followed by forming a slack again by the slack forming unit, or if the remaining amount of paper detected by the detecting unit is less than the threshold value, performs another mode of control operation including transporting the continuous paper with a slack formed thereon by the slack forming unit; and a cutting controller that controls the cutting unit to cut the continuous paper during a time taken to tighten the slack formed by the slack forming unit.

9. An image forming apparatus comprising:

an image output part that outputs an image on continuous paper;

a paper feed unit that feeds continuous paper to the image output part;

a slack forming unit that forms a slack of continuous paper on a paper transport path through which the continuous paper is fed by the paper feed unit;

a detecting unit that detects a remaining amount of continuous paper;

a cutting unit that cuts the continuous paper;

a transport controller that, when transporting paper whose length is more than a predefined value which has been set beforehand, and if a paper length specified for a print request accepted is shorter than the remaining amount of paper detected by the detecting unit, performs one mode of control operation including reducing a length of a slack formed by the slack forming unit and transporting the continuous paper, followed by forming a slack again by the slack forming unit, or if the paper length specified for the print request accepted is longer than the remaining amount of paper detected by the detecting unit, performs another mode of control operation including transporting the continuous paper with a slack formed thereon by the slack forming unit; and a cutting controller that controls the cutting unit to cut the continuous paper during a time taken to tighten the slack formed by the slack forming unit.

10. A continuous paper feeding method comprising:

feeding continuous paper to an image output part;

forming a slack of continuous paper on a paper transport path through which the continuous paper is fed;

comparing a remaining amount of continuous paper with a threshold value;

if the remaining amount of continuous paper is equal to or more than the threshold value, reducing a length of a slack formed and transporting the continuous paper, followed by forming a slack again;

if the remaining amount of continuous paper is less than the threshold value, transporting the continuous paper with a slack formed thereon; and cutting the continuous paper during a time taken to tighten the slack.

11. A continuous paper feeding method comprising:

feeding continuous paper to an image output part;

forming a slack of continuous paper on a paper transport path through which the continuous paper is fed;

comparing a remaining amount of continuous paper with a paper length specified for a print request accepted;

if the remaining amount of continuous paper is longer than the paper length specified for the print request accepted, reducing a length of a slack formed and transporting the continuous paper, followed by forming a slack again;

if the remaining amount of continuous paper is shorter than the paper length specified for the print request accepted, transporting the continuous paper with a slack formed thereon; and cutting the continuous paper during a time taken to tighten the slack.

12. A non-transitory computer readable medium storing a program causing a computer to execute a process comprising:

feeding continuous paper to an image output part;

forming a slack of continuous paper on a paper transport path through which the continuous paper is fed;

comparing a remaining amount of continuous paper with a threshold value;

if the remaining amount of continuous paper is equal to or more than the threshold value, reducing a length of a slack formed and transporting the continuous paper, followed by forming a slack again;

if the remaining amount of continuous paper is less than the threshold value, transporting the continuous paper with a slack formed thereon; and cutting the continuous paper during a time taken to tighten the slack.

13. A non-transitory computer readable medium storing a program causing a computer to execute a process comprising:

feeding continuous paper to an image output part;

forming a slack of continuous paper on a paper transport path through which the continuous paper is fed;

comparing a remaining amount of continuous paper with a paper length specified for a print request accepted;

if the remaining amount of continuous paper is longer than the paper length specified for the print request accepted, reducing a length of a slack formed and transporting the continuous paper, followed by forming a slack again;

if the remaining amount of continuous paper is shorter than the paper length specified for the print request accepted, transporting the continuous paper with a slack formed thereon; and cutting the continuous paper during a time taken to tighten the slack.

* * * * *